US006827148B2

(12) United States Patent
Shaw et al.

(10) Patent No.: US 6,827,148 B2
(45) Date of Patent: Dec. 7, 2004

(54) DOWNHOLE TOOL FOR USE IN A WELLBORE

(75) Inventors: Joel D. Shaw, Houston, TX (US); David W. Teale, Spring, TX (US); Mary L. Laird, Breaux Bridge, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 6 days.

(21) Appl. No.: 10/154,489

(22) Filed: May 22, 2002

(65) Prior Publication Data

US 2003/0217850 A1 Nov. 27, 2003

(51) Int. Cl.[7] ..... E21B 23/00
(52) U.S. Cl. ..... 166/381; 166/255.1; 294/86.15
(58) Field of Search ..... 166/374, 383, 166/381, 255.1, 319; 294/86.14, 86.15, 86.16

(56) References Cited

U.S. PATENT DOCUMENTS

| | | | | |
|---|---|---|---|---|
| 3,749,119 A | * | 7/1973 | Tausch et al. | 137/461 |
| 3,888,306 A | | 6/1975 | Wetzel | 166/255 |
| 4,067,386 A | | 1/1978 | Weise | 166/64 |
| 4,282,942 A | * | 8/1981 | Longmore | 175/269 |
| 4,566,478 A | | 1/1986 | Deaton | 137/112 |
| 5,092,402 A | | 3/1992 | Perricone et al. | 166/113 |
| 5,113,703 A | * | 5/1992 | Hearn | 73/152.18 |
| 5,242,201 A | | 9/1993 | Beeman | 294/86.17 |
| 5,269,374 A | | 12/1993 | Taylor | 166/255 |
| 5,456,312 A | * | 10/1995 | Lynde et al. | 166/55.6 |
| 5,580,114 A | | 12/1996 | Palmer | 294/86.15 |
| 5,735,359 A | | 4/1998 | Lee et al. | 175/269 |
| 5,775,433 A | * | 7/1998 | Hammett et al. | 166/98 |
| 5,791,712 A | | 8/1998 | Hawn | 294/86.15 |
| 6,328,055 B1 | * | 12/2001 | Burris, II | 137/68.23 |
| 6,378,626 B1 | * | 4/2002 | Wallace | 175/19 |

OTHER PUBLICATIONS

PCT International Search Report, International Application No. PCT/US 03/15804, dated Oct. 15, 2003.

* cited by examiner

*Primary Examiner*—David Bagnell
*Assistant Examiner*—Daniel P Stephenson
(74) *Attorney, Agent, or Firm*—Moser, Patterson & Sheridan

(57) ABSTRACT

The present invention provides a method and an apparatus for use in a wellbore tool. The apparatus includes a body and a sliding member, wherein the sliding member and a mechanical portion moves between a first position and a second position. A valve assembly causes the sliding member and mechanical portion to shift to its second position at a predetermined flow rate of fluid through the body. The invention also provides an apparatus for a downhole tool that includes a mandrel and a sliding member disposed on the mandrel. The sliding member including a plurality of fingers and a plurality of heads, wherein the plurality of fingers are slideably recessed within a plurality of longitudinal grooves. The invention further provides a collet assembly that includes a body and at least two extendable members, whereby as the members extend outward, the members are rotated.

36 Claims, 10 Drawing Sheets

FIG. 5
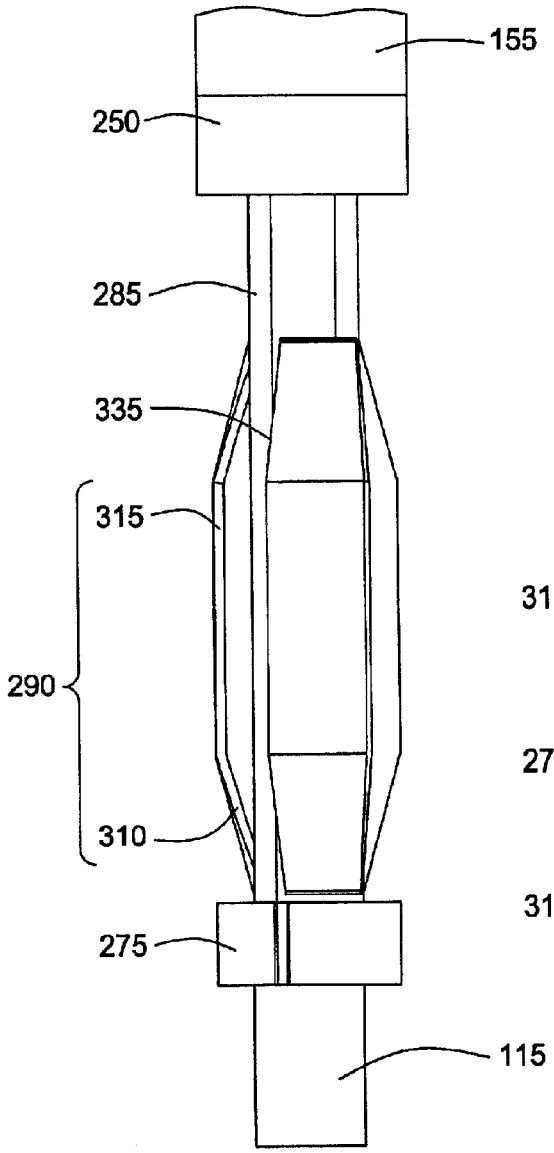
FIG. 6
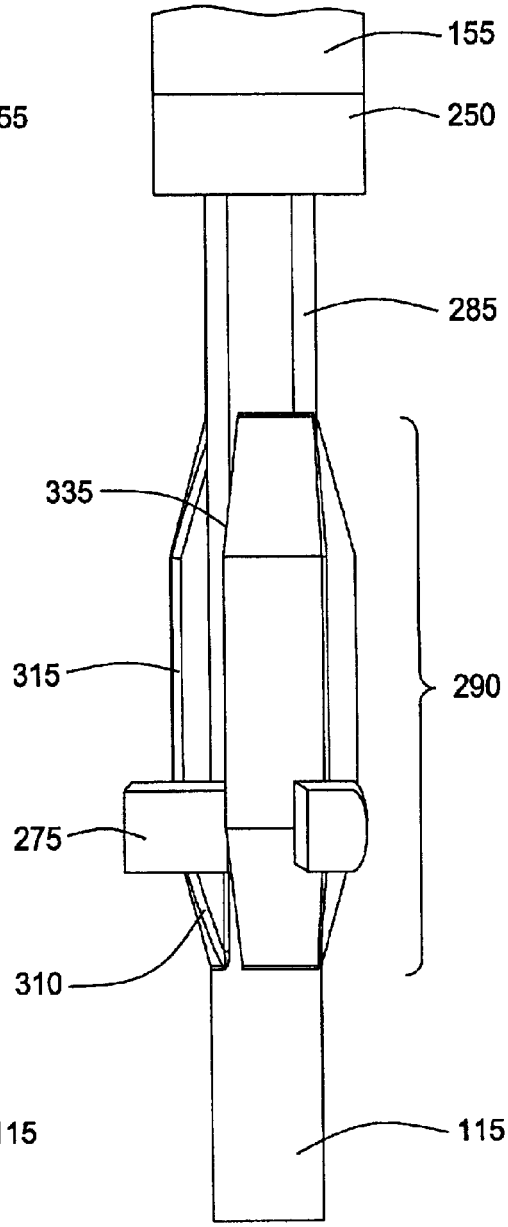
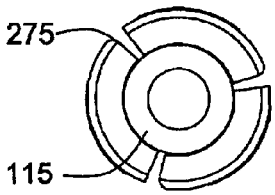
FIG. 5A
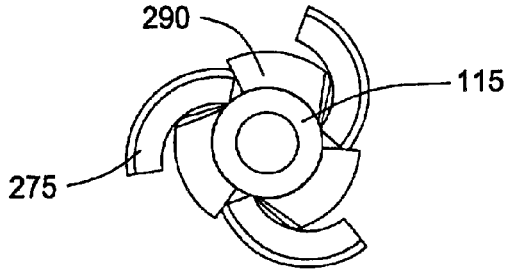
FIG. 6A

DOWNHOLE TOOL FOR USE IN A WELLBORE

BACKGROUND OF THE INVENTION

1. Field of the Invention

The present invention generally relates to an apparatus and methods for drilling, completion and rework of wells. More particularly, the invention relates to an apparatus and methods for activating and releasing downhole tools. More particularly still, the invention provides a hydraulically activated downhole tool.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of steel pipe called casing. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

It is common to employ more than one string of casing in a wellbore. In this respect, a first string of casing is set in the wellbore when the well is drilled to a first designated depth. The well is then drilled to a second designated depth, and a second string of casing, or liner, is run into the well to a depth, whereby the upper portion of the second liner is overlapping the lower portion of the first string of casing. This process is typically repeated with additional casing strings until the well has been drilled to total depth. To properly place the additional casing strings within the wellbore, the end of the existing casing must be determined. A downhole tool, such as a tubing end locator, is typically employed to accurately locate the end of the existing casing.

Typically, a conventional tubing end locator is run downhole on a tubing string. The end of the tubing is indicated when the tubing end locator runs out the end of the tubing and is then brought back uphole, thus shearing the finger and indicating the depth of the tubing. Therefore, conventional tubing end locators employing calipers, fingers or other protrusions are capable of only reading the end of the tubing once, and thus yield a low level of accuracy as to the depth of the tubing. Consequently, when a conventional tubing end locator is run downhole and brought back uphole at the tubing end, the caliper or finger is sheared completely off thus indicating the end of the tubing and destroying the caliper or finger and requiring the tubing end locator to be brought back uphole to be re-worked or retooled.

A conventional tubing end locator may also be used to locate a preformed inner diameter profile, a collar or a nipple in an existing downhole casing. Conventional tubing end locators implement calipers or fingers which extend vertically upward and outwardly from the tubing end locator such that each caliper or finger is spring loaded and exerts an external pressure against the internal diameter and circumference of the tubing. Each caliper or finger deflects at each inner diameter profile juncture, thus indicating the location of the preformed profile, collar or nipple is located.

Another form of a conventional tubing locator employs the use of bow springs to locate a preformed inner diameter profile, a collar or a nipple in an existing downhole casing. The locator tool includes high compressive springs and a set of bow springs extending radially from a mandrel on the tool. The bow springs extend vertically, longitudinally and radially outward from the mandrel thus contacting the internal circumference and surface of the casing or tubing, and establishing a constant internal resistance detected uphole at the surface. When the bow springs contact a preformed inner diameter profile, a collar, a nipple or tubing end, the bow springs will move either upwardly towards the surface at each collar indication, or downwardly towards the end of the tubing at each tubing end indication.

Several problems may occur using a conventional tubing locator during a locator operation. One problem occurs when an excessive overpull is applied at the surface of the well during the location of the preformed inner diameter profile, collar, nipple or tubing end. In this case, the conventional tubing locator does not provide a failsafe mechanism that allows the locator tool to release and reset after applying the excessive overpull. Another problem occurs during the indication phase of the locator operation. After the conventional tubing locator has located the profile or tubing end, an overpull indication must be detectable at the surface of the well. However, the conventional tubing locator tool is unable to withstand an overpull that is easily detectable at the surface, therefore unable to accurately to determine the location of the profile.

Other downhole tools are used throughout the well completion process. One such downhole tool is a conventional under-reamer. Generally, the conventional under-reamer is used to enlarge the diameter of wellbore by cutting away a portion of the inner diameter of the existing wellbore. A conventional under-reamer is typically run down hole on a tubing string to a predetermined location with the under-reamer blades in a closed position. Subsequently, fluid is pumped into the conventional under-reamer and the blades extend outward into contact with the surrounding wellbore. Thereafter, the blades are rotated through hydraulic means and the front blades enlarge the diameter of the existing wellbore as the conventional under-reamer is urged further into the wellbore.

The conventional under reamer may also be used in a back-reaming operation. In the same manner as the under-reaming operation, the fluid is pumped into the under-reamer and the blades extend outward into contact with the surrounding wellbore. Thereafter, the blades are rotated through hydraulic means and the back blades enlarge the diameter of the existing wellbore as the under-reamer is urged toward the surface of the wellbore.

Several problems may occur using a conventional under-reamer during an under-reaming or back-reaming operation. One problem occurs when an unmovable obstruction is encountered during the under-reaming or back-reaming operation. In this situation, the front or the back blades on the conventional under-reamer may be damaged as the under-reamer is urged furthered toward the unmovable obstruction. Another problem is particularly associated with the back-reaming operation. During the back-reaming operation, the blades must remain open and the under-reamer must be able to withstand a strong pulling force to effectively remove a portion of the existing wellbore diameter. However, the conventional under-reamer typically is unable to remain open during a back-reaming operation to effectively enlarge the wellbore diameter.

A need therefore exists for apparatus with a hydraulic valving system that provides a failsafe mechanism that allows the apparatus to withstand a sufficient overpull while permitting the apparatus to release and reset after applying an excessive overpull. There is yet a further need for an apparatus with a hydraulic valving system that will provide a failsafe mechanism that allows the apparatus to close when an unmovable obstruction is encountered. There is a final need for an apparatus with a hydraulic valving system that ensures the apparatus will remain open during a back-reaming operation.

SUMMARY OF THE INVENTION

The present invention provides a method and an apparatus for use in a wellbore tool. The apparatus includes a body having a center bore and at least one side port permitting fluid communication between the bore and an annular area between the tool and the wellbore. The apparatus further includes a sliding member, wherein the sliding member moves between a first position and a second position and a valve assembly that causes the sliding member to shift to its second position at a predetermined flow rate of fluid through the body. The apparatus also includes a mechanical portion movable with the sliding member between the first and second positions.

In another embodiment, the invention provides for an apparatus for a downhole tool that includes a mandrel, a plurality of ramped sections radially disposed around the mandrel and a plurality of longitudinal grooves radially disposed between the plurality of ramped sections. The invention further includes a sliding member disposed on the mandrel, the sliding member movable between a first and second position the sliding member including a plurality of fingers and a plurality of heads, wherein the plurality of fingers are slideably recessed within the plurality of longitudinal grooves.

In another embodiment, the invention provides a collet assembly for use in a wellbore, the collet assembly includes a body and at least two extendable members movable independent of the body, the members are extendable outwards. The collet assembly further includes a sliding member attached to each member, the sliding member remotely movable between a first and second position. The collet assembly also includes a ramp formed on the body whereby, the members are urged along the surface to extend outwards and as the members are extended outwards, the members are rotated.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 5 is a cross sectional view of an alternative embodiment of the collet for use with the apparatus.

FIG. 5A is a bottom view of the embodiment shown on FIG. 5.

FIG. 6 is a cross sectional view illustrating the radial expansion of the collet.

FIG. 6A is a bottom view of the embodiment shown on FIG. 6.

DETAILED DESCRIPTION OF THE PREFERRED EMBODIMENT

Figure 1:
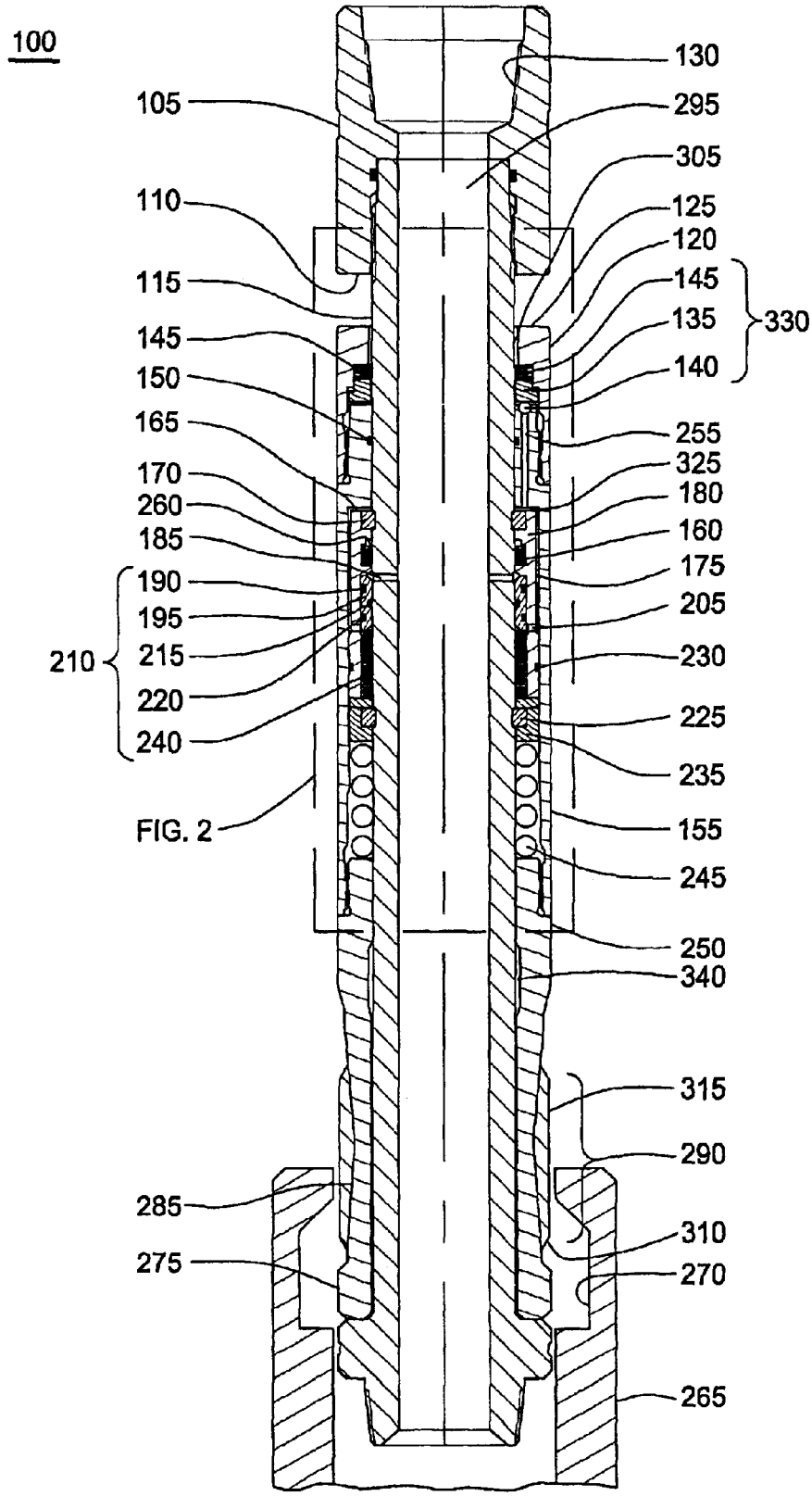
FIG. 1 illustrates a cross-sectional view of one embodiment of an apparatus in accordance with the present invention.

FIG. 1 illustrates a cross-sectional view of one embodiment of the invention used with a locator tool 100. Typically, the locator tool is run into the wellbore on tubing string to a predetermined point. Thereafter, the locator tool is activated causing fingers to expand radially outward and then locator tool is slowly pulled upward in the wellbore to find a preformed profile within an existing tubular. When a weight gage shows an increase in overpull, the locator tool will be located in the profile.

As shown in FIG. 1, the tool 100 includes a top sub 105. The top sub 105 includes an internal threaded section 130 to accept a tubing string (not shown). The top sub 105 further includes a shoulder 110 at a lower end to be used as a stop during operation of the tool 100. The top sub 105 is connected to an upper portion of a mandrel 115 or body via another threaded connection. As illustrated, the mandrel 115 runs the entire length of tool 100. The mandrel 115 includes a bore 295 to act as a fluid conduit through the tool 100.

A spring housing 120 is disposed at the upper end of the mandrel 115. The spring housing 120 includes a spring housing shoulder 125 to abut shoulder 110 during operation of the apparatus 100. The spring housing 120 encloses a relief valve 330. In this embodiment, the relief valve 330 includes a first biasing member 145, an upper piston 135, and a ball 140. However, other forms of relief valves may be employed, so long as they are capable of selectively controlling fluid flow. The main function of the relief valve 330 is to provide a means of releasing fluid from a chamber 325 when fluid pressure within the chamber 325 reaches a predetermined level. As shown, the first biasing member 145 is disposed between the spring housing 120 and the mandrel 115 and biases the movement of the upper piston 135. Upon a fluid force the ball 140 acts against the upper piston 135, thereby urging the upper piston 135 axially in the spring housing 120. The spring housing 120 further includes a spring housing passageway 305 to allow fluid to exit apparatus 100.

FIG. 1 further illustrates a housing 155 or sliding member disposed around mandrel 115. The housing 155 is movable between a first and a second position. The housing 155 includes a housing passageway 255 that acts a conduit for fluid to activate the relief valve 330. An upper seal 150 is disposed between the mandrel 115 and the housing 155 and creates a fluid tight seal between the mandrel 115 and the housing 155, thereby preventing fluid from traveling out the mandrel 115. Additionally, a chamber shoulder 165 is formed in the housing 155 to be later used to urge the housing 155 axially upward.

An upper dog 170 is disposed around mandrel 115 below the chamber 325. The upper dog 170 secures a lower piston housing 180 to the mandrel 115. The lower piston housing 180 is disposed beneath a portion of housing 155 and encloses a one-way check valve 160. In the preferred embodiment, the check valve 160 is a unidirectional pressure energized seal. However, other forms of the check valves may be employed, so long as they are capable of selectively controlling fluid flow. The primary function of the one way check valve 160 is to permit fluid flow from a port 185 into an inner passageway 260 while preventing fluid exiting the inner passageway 260 to the port 185.

As shown on FIG. 1, the port 185 in the mandrel 115 permits fluid from the mandrel passageway 295 to pass through the check valve 160 and subsequently in to the inner passageway 260 that is formed between the lower piston housing 180 in the mandrel 115. The inner passageway 260 connects the check valve 160 to the chamber 325 and then to an outer passageway 175. The outer passageway 175 is formed between the lower piston housing 180 and the housing 155. The lower piston housing 180 further includes an aperture 205 that connects to the outer passageway 175 to an inner portion of the lower piston housing 180.

The inner portion of the lower piston housing 180 contains a low flow valve 210. The primary function of the low flow valve 210 is to permit fluid to exit the apparatus 100 at a low pressure differential in the mandrel passageway 295 while preventing fluid from exiting the apparatus 100 at a high pressure differential. In the preferred embodiment, the low flow valve 210 includes a lower piston 195, a second biasing member 240 and a plurality of seals. However, other forms of low flow valves may be employed, so long as they are capable of selectively controlling fluid flow at predetermined pressures.

The lower piston 195 is movable between a first and a second position. As illustrated on FIG. 1, the lower piston 195 is biased upward by the second biasing member 240 in the first position, thereby allowing fluid flow from the aperture 205. As depicted, the second biasing member 240 consists of wave springs. However, other forms of biasing members, such as coil springs, wave washers or combinations thereof may be employed.

The low flow valve 210 includes a plurality of seals to prevent fluid leakage. In this respect, a first piston seal 215 is disposed on the inner portion of the lower piston 195 to create a fluid tight seal between the lower piston 195 and the mandrel 115. Furthermore, a second and a third piston seal 190, 220 are disposed between the lower piston housing 180 and an outer portion of the lower piston 195. The second and third piston seal 190, 220 are used to create a fluid tight seal around aperture 205 after the lower piston 195 moves axially downward to the second position. In addition, a lower seal 230 is disposed around the lower piston housing 180 to create a fluid tight seal between the lower piston housing 180 and the housing 155.

A dog housing 235 is disposed at the lower end of the piston housing 180. The dog housing 235 is held at a predetermined location on the mandrel 115 by a lower dog 225. The second biasing member 240 abuts against the dog housing 235. In this respect, the dog housing 235 acts as a support member for the second biasing member 240. In the same manner, the dog housing 235 acts as a support member for a third biasing member 245.

The third biasing member 245 is disposed around mandrel 115 and captured between the dog housing 235 and a collet 250 or mechanical portion. The third biasing member 245 is constructing and arranged to permit axial movement of the collet 250 upon at predetermined force. In the preferred embodiment, the third biasing member 245 is a coiled spring. However it is within the scope of the present invention to use other forms of a biasing member, so long as they are capable of providing the necessary force to bias the collet 250.

As depicted on FIG. 1, the collet 250 is in a first position. The collet 250 is an annular member disposed of around mandrel 115 and connected to the housing 155. The collet 250 moves between the first position and a second position along an axial path on mandrel 115. In the preferred embodiment, the collet 250 includes a plurality of equally spaced collet fingers 285. Each of the fingers 285 includes a collet head 275. As shown, the collet 250 in the first position permits the collet fingers 285 and the collet head 275 to rest against the lower portion of the mandrel 115.

As shown on FIG. 1, the lower portion of mandrel 115 includes a plurality of equally spaced ramp sections 290. In the preferred embodiment, the numbers of ramp sections 290 correspond to number of collet fingers 285. Each ramp section includes a tapered surface 310 and a substantially flat surface 315. The ramp sections 290 are constructed to interface with the collet heads 275 during operation of the apparatus 100. It should be noted that the outer portion of the collet 275 is a radial distance equal to or less than the radial distance of the outer portion of the ramp sections 290, thereby allowing the apparatus 100 to obtain the location of a tubular 265 with a small inside diameter as shown on FIG. 1.

Figure 1A:
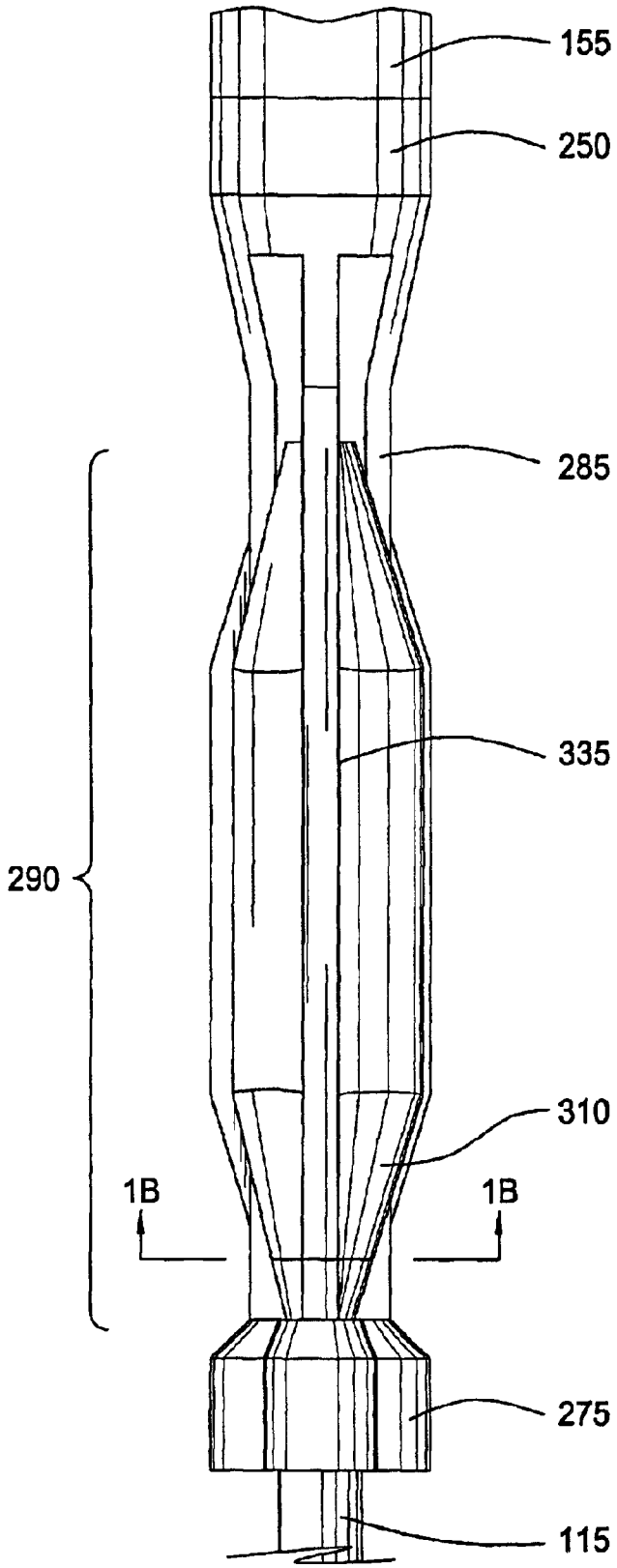
FIG. 1A is a side view of the collet fingers and the collet head.
Figure 1B:
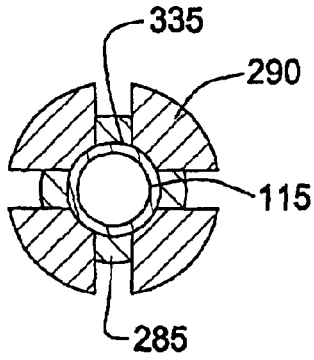
FIG. 1B is a section view of FIG. 1A illustrating the collet fingers disposed in the grooves.

FIG. 1A is a side view of the collet fingers 285 and the collet heads 275. Visible specifically are heads 275 formed at an end of fingers 285 that are attached to the housing 155 at an upper end. The heads 275 are constructed and arranged to act on the tapered surfaces 310 of the mandrel 115 as the heads 275 are moved upwards relative to the tapered surfaces 310. The mandrel 115 includes grooves 335 for housing the collet fingers 285, the grooves 335 are formed longitudinally between the ramped sections 290. In this manner, the fingers 285 are recessed in the mandrel 115. FIG. 1B is a section view of FIG. 1A illustrating the fingers 285 disposed in the grooves 335.

Figure 2:
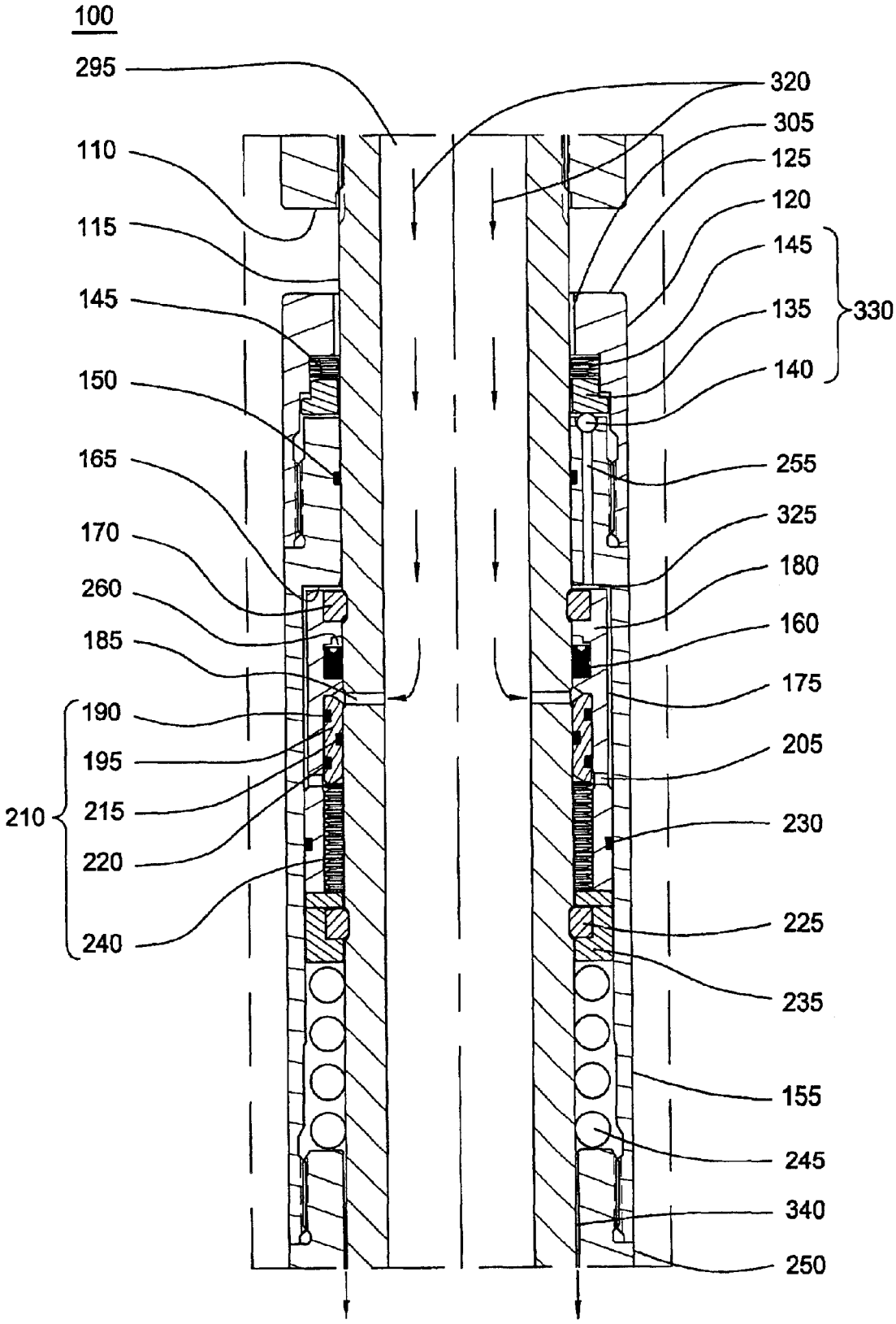
FIG. 2 is an enlarged cross-sectional view of apparatus illustrating the flow of fluid though the apparatus prior to the actuation of the collet.

FIG. 2 is an enlarged cross-sectional view of the apparatus 100 illustrating the flow of fluid though the apparatus 100 prior to actuation of the collet 250. During operation, fluid from the surface of the wellbore is pumped through the mandrel passageway 295 typically to some other downhole tool (not shown) such as a nozzle or mud motor. A pressure differential causes the fluid to pass through port 185, as illustrated by arrow 320. From port 185, the fluid flows through check valve 160 and into the inner passageway 260. Fluid continues through the inner passageway 260 around the upper dog 170 and into the chamber 325 and then into the outer passageway 175. Next, fluid in the outer passageway 175 flows inwardly through aperture 205. From aperture 205, fluid flows through the second biasing member 240, around the lower dog 225, and third biasing member 245 exiting the tool 100 through a collet passageway 340. In this manner, a portion of the fluid within the mandrel bore 295 exits the tool 100 into the surrounding wellbore.

Figure 3:
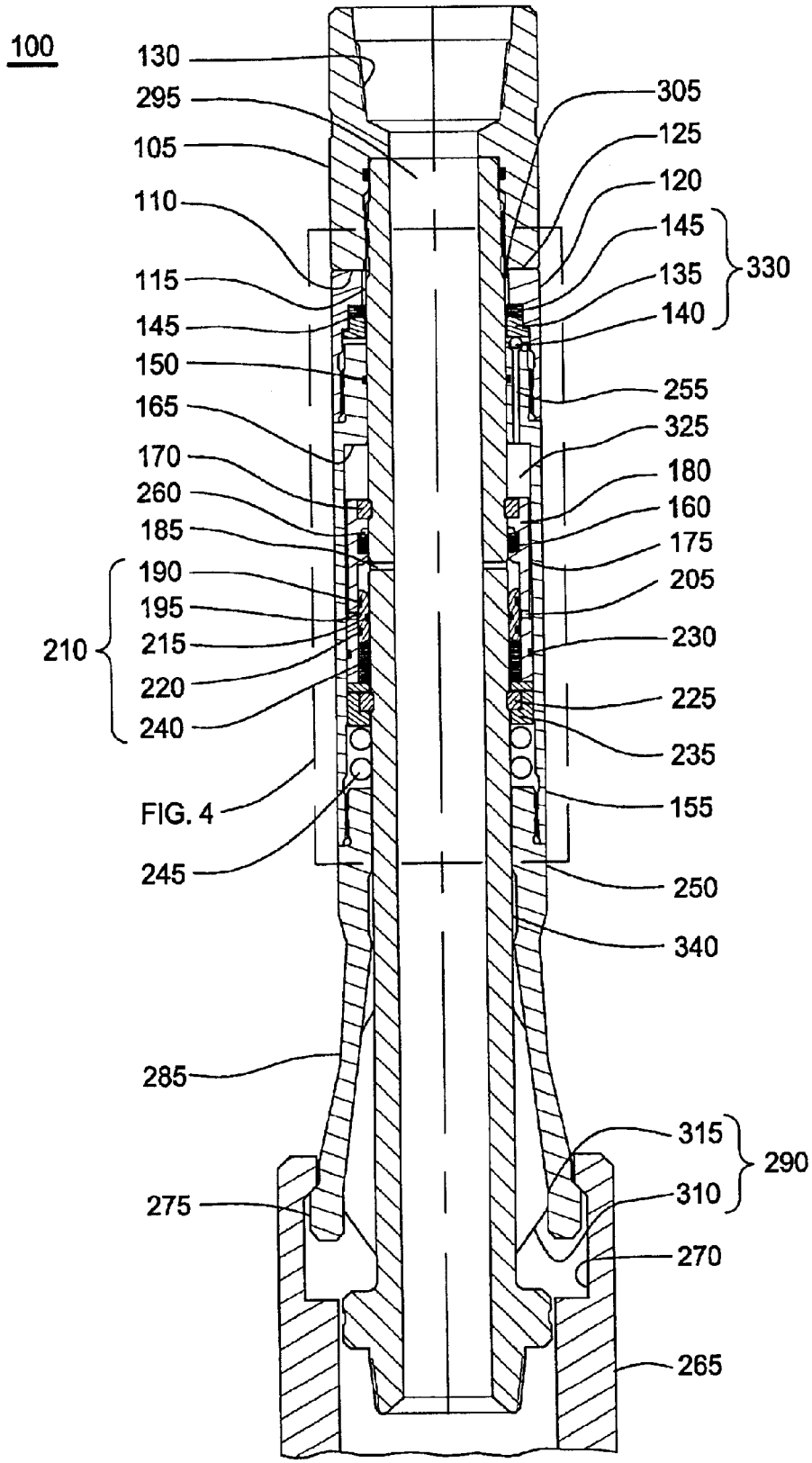
FIG. 3 is a cross-sectional view of the apparatus after the collet head has expanded outward into contact with a tubular.

FIG. 3 is a cross-sectional view of the apparatus 100 after the collet head 275 has expanded outward into contact with the tubular 265. As the fluid flow is increases the differential pressure within the mandrel passageway 295 increases, thereby causing pressurized fluid to enter port 185. The pressurized fluid entering the port 185 creates a force that acts against the upper portion of piston 195 in the low flow valve 210. At a predetermined point, the force against the upper portion of piston 195 becomes greater then the biasing force on the lower portion of the piston 195 created by the second biasing member 240. At that point, the lower piston 195 starts to move axially downward compressing the second biasing member 240. The piston 195 continues to move axially downward until the third piston seal 220 passes aperture 205 as shown on FIG. 3. In this manner, the movement of the piston 195 to the second position closes off the fluid pathway through the aperture 205.

Thereafter, fluid entering the port 185 flows through the one-way check valve 160 into the inner passageway 260 and around the upper dog 170. The fluid is prevented from flowing through the aperture 205 because the aperture 205 is closed. Therefore, fluid pressure builds within the chamber 325 and creates a force that acts against the chamber shoulder 165. At a predetermined point, the force on the chamber shoulder 165 becomes greater than the biasing force created by the third biasing member 245. At that point, the chamber 325 fills with fluid, thereby urging the housing 155 axially upward and compressing the third biasing member 245. The housing 155 continues to move axially upward until the spring housing shoulder 120 contacts the sub shoulder 110. At that point, the housing 155 reaches the second position.

The movement of the housing 155 to the second position causes the collet 250 to move axially upward to the second position since the collet 250 is connected to the housing 155. As the collet 250 starts to move axially upward, the collet head 275 slides along the tapered surface 310 toward the flat surface 315 of the ramped section 290. The movement of the collet head 275 along the tapered surface 310 causes the collet head 275 to move radially outward into contact with a surrounding tubular 265. As shown, the collet head 275 is in full contact with a groove 270 formed in the tubular 265.

The collet 250 and housing 155 may be shifted from the second position to the first position by reducing the flow of fluid through the mandrel passageway 295. As the fluid flow is reduced, the differential pressure within mandrel passageway 295 is also reduced, thereby allowing the lower piston 195 to move axially upward exposing the aperture 205. Thereafter, fluid from the chamber 325 and the mandrel passageway 295 may flow into the aperture 205 and through the second biasing member 240 exiting out the collet passageway 340 as discussed in a previous paragraph. In this manner, the fluid in the chamber 325 is removed allowing the third biasing member 245 to urge the collet 250 and the housing 155 from the second position to the first position, thereby disengaging the collet head 275 from the tubular 265.

Figure 3A:
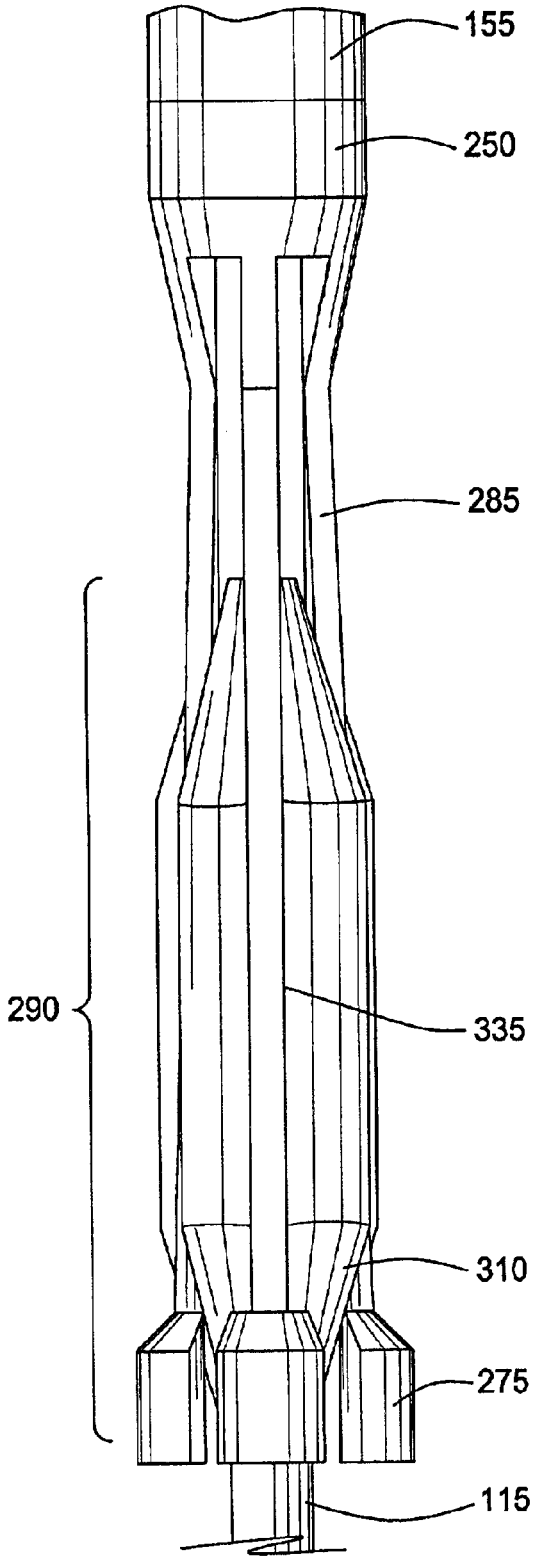
FIG. 3A is a side view of the collet fingers and the collet head illustrating the collet head expanded outward.

FIG. 3A is a side view of the collet fingers 285 and the collet heads 275 illustrating the collet heads 275 expanded outward. As shown, the collet fingers 285 have moved axially upward within the grooves 335. As further shown, the collet heads 275 have traveled up a portion of the tapered surface 310, thereby causing the collet heads 275 to extend radially outward.

Figure 4:
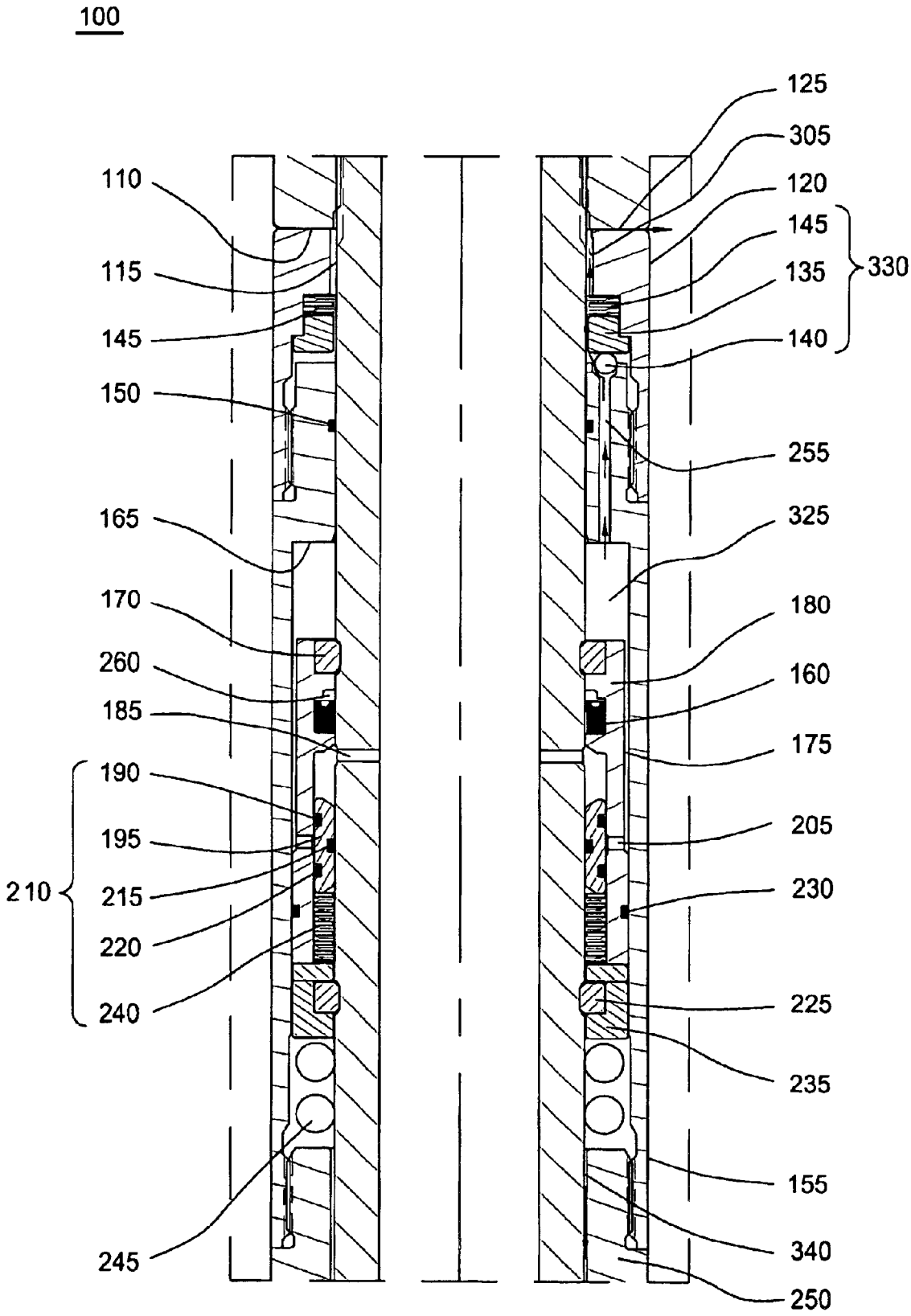
FIG. 4 is an enlarged cross-sectional view of the apparatus illustrating the activation of a relief valve.

FIG. 4 is an enlarged cross-sectional view of apparatus 100 illustrating the activation of the relief valve 330. The main function of the relief valve 330 is to provide a means of releasing fluid from chamber 325 when the pressure within the chamber 325 reaches a predetermined amount. After the collet head 275 is fully engaged with the tubular 265 as shown in FIG. 3, the tubing string and apparatus 100 is pulled upward to verify location of the tubular 265. A sensing device (not shown) connected to the tubing string indicates the upward force. If the force indicated on the sensing device is within a specific range then there is full engagement of the collet head 275 and the tubular 265. However, the upward force may break the collet fingers 285 if the force is not maintained within a predetermined range. To prevent damage to the collet fingers 285, the relief valve 330 senses the pressure build up in chamber 325 and releases fluid out of the chamber 325, thereby causing the housing 155 and the collet 250 to move from the second position to the first position. The movement to the first position causes the collet head 275 to release the tubular 265, thereby preventing damage to the collet fingers 285. In this manner, the relief valve 330 acts as a backup to the hydraulic system, thereby preventing damage to the apparatus 100.

The increased pressure in the chamber 325 creates a force in the fluid located in housing passageway 255. The fluid force acts against the ball 140. At a predetermined point, the force on the ball 140 becomes greater than the biasing force created by the first biasing member 145. At that point, the ball 140 urges the upper piston 135 axially upward, thereby compressing the first biasing member 145. The upward movement of the ball 140 and the upper piston 135 exposes the spring housing passageway 305. Therefore, fluid in the chamber 325 is permitted to travel up the housing passageway 255 and exit out the apparatus 100 through the spring housing passageway 305. In this respect, the housing 155 and the collet 250 is permitted to return to the first position.

FIG. 5 is a cross sectional view of an alternative embodiment of the collet 250 for use with the apparatus 100. In this embodiment, rotational movement is used to engage the collet head 275 with the surrounding tubular (not shown). The collet 250 is moveable between the first and second position in the same manner as described in the previous paragraphs. FIG. 5 illustrates the collet 250 in the first position, wherein the collet head 275 is in contact with the mandrel 115. The collet head 275 is constructed and arranged to act on the tapered surface 310 of the mandrel 115 as the head 275 is moved upward relative to the tapered surface 310. The mandrel 115 includes grooves 335 formed longitudinally between the ramped sections 290 for housing the collet fingers 285. In this manner, the fingers 285 are recessed in the mandrel 115. FIG. 5A is a bottom view of the embodiment shown on FIG. 5.

FIG. 6 is a cross sectional view illustrating the radial expansion of the collet 250. As shown, the collet fingers 285 have moved axially upward in the grooves 335. As further shown, the collet heads 275 have traveled up a portion of the tapered surface 310, thereby causing the collet heads 275 to rotate outward. The rotation of the collet heads 275 causes a rotational force to act against the collet fingers 285. The collet fingers 285 are constructed and arranged of a material that permits a predetermined rotational force to be applied to the collet fingers 285 when the collet 250 is in the second position while allowing the collet fingers 285 to return to the original shape when the collet 250 is in the first position. In this manner, the collet heads 275 are rotated outward allowing collet heads 275 to radially expand into contact with a profile (not shown). FIG. 6A is a bottom view of the embodiment shown on FIG. 6.

Figure 7:
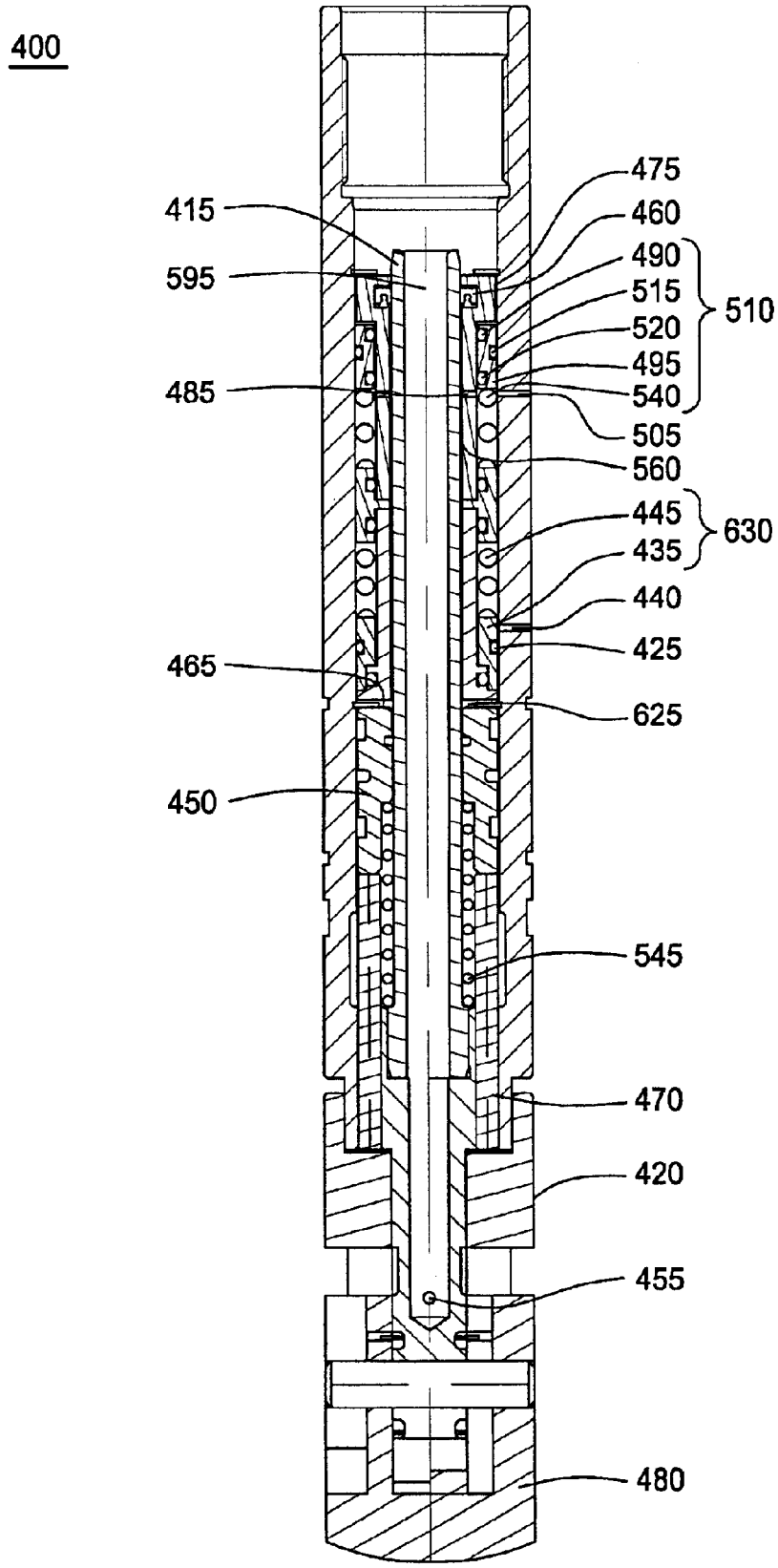
FIG. 7 is a cross sectional view of another embodiment of the apparatus in accordance with the present invention.

FIG. 7 is a cross sectional view of another embodiment of the apparatus 400 in accordance with the present invention. As shown, apparatus 400 is downhole tool called an under-reamer. Typically, an under-reamer is run down hole with the blades in a closed position to a predetermined location. Subsequently, fluid is pumped into the under-reamer and the blades extend outward into contact with the surrounding wellbore. Thereafter, the blades are rotated through hydraulic means and the under reamer is urged downward enlarging the diameter of wellbore. The under reamer may also be used in a back reaming operation. During a back reaming operation, the under reamer is pulled toward the surface of the well while the blades enlarge the wellbore diameter.

As shown on FIG. 7, the apparatus 400 includes many of the same components of the apparatus 100. For example, a mandrel 115, 415, a mandrel passageway 295, 595, a check valve 160, 460, a first biasing member 145, 445, upper piston 135, 435, a relief valve 330, 630, a chamber 325, 625, an outer passageway 175, 475, an aperture 205, 505, a shoulder 165, 465, an inner passageway 260, 560, a port 185, 485, a low flow valve 210, 510, a first piston seal 215, 515 a second piston seal 190, 490, a third piston seal 220, 520, a lower piston 195, 495, a second biasing member 240, 540, and a third biasing member 245, 545. Each of the components listed function in the same manner as previously discussed for the apparatus 100.

Additional components used in the apparatus 400 include an exit aperture 440 to allow fluid to exit the relief valve 630 and a seal member 425 to seal the relief valve 630. The apparatus 400 further includes a bottom port 455 to allow fluid to exit the apparatus 400. Additionally, apparatus 400 includes a piston 450 that moves between a first position and a second position due to fluid pressure in the chamber 625. The lower end of the piston 450 abuts against rods 470. The rods 470 are used to open and close a blade mechanism 420 that controls a pair of blades 480. As shown on FIG. 7, the blades 480 in a closed position.

Figure 8:
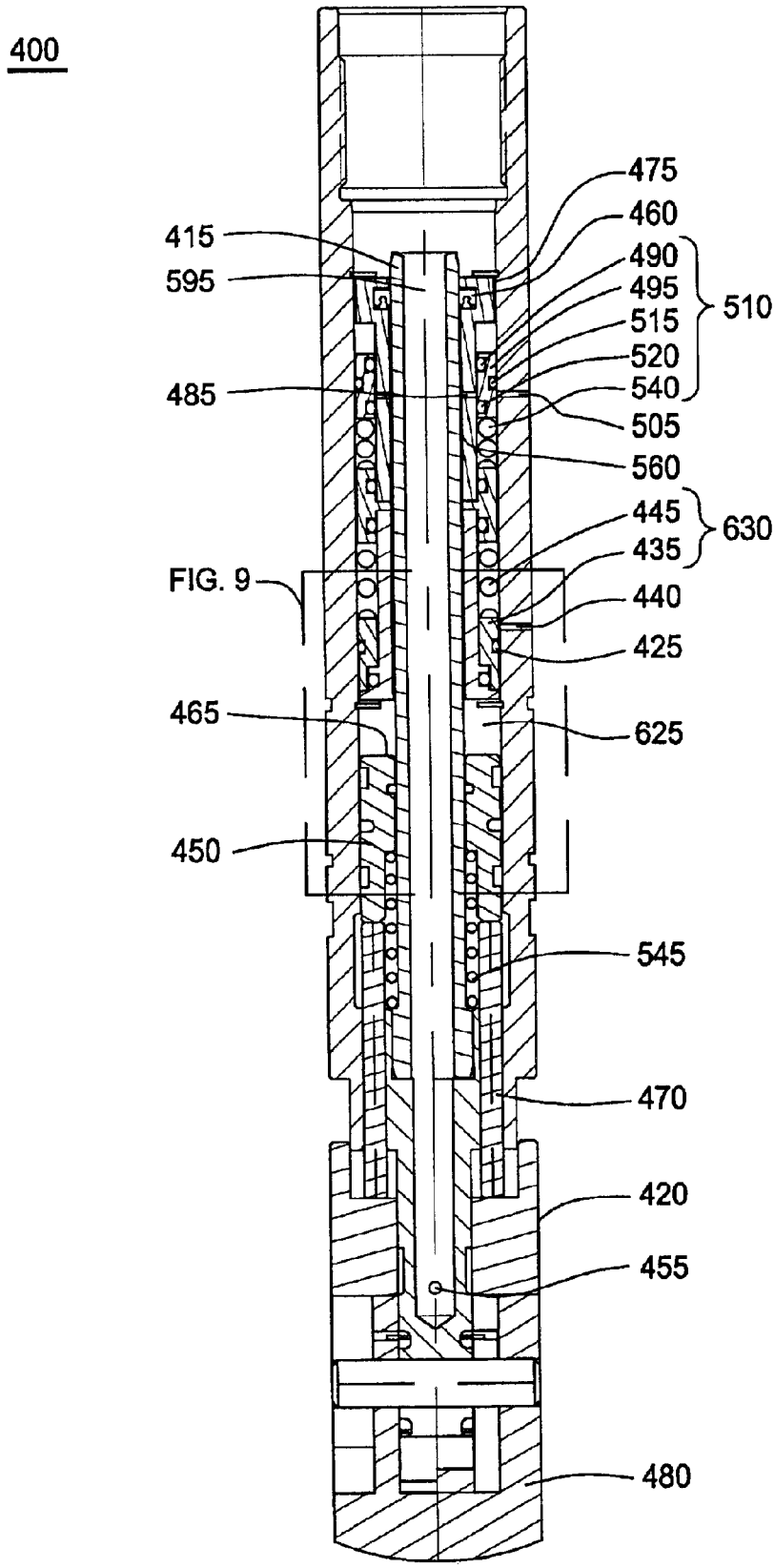
FIG. 8 illustrates a cross sectional view of the apparatus after the blades have expanded outward.

FIG. 8 illustrates a cross sectional view of the apparatus 400 after the blades 480 has expanded outward. During operation of apparatus 400, fluid is pumped through the mandrel passageway 595 exiting out the bottom port 455. As fluid flows through the bottom port 455, a pressure differential created in the passageway 595. The pressure differential causes fluid to enter the check valve 490 and exit through aperture 505.

As the fluid flow is increased the differential pressure increases within the mandrel passageway 595 causing fluid to enter the outer passageway 475. As the fluid fills the outer passageway 475, a force is created that acts against the upper portion of piston 495 in the low flow valve 510. At a predetermined point, the force against the upper portion of piston 495 becomes greater then the biasing force on the lower portion of the piston 495 created by the second biasing member 540. At that point, the lower piston 495 starts to move axially downward compressing the second biasing member 540. The piston 495 continues to move axially downward until the third piston seal 520 passes aperture 485 as shown on FIG. 8. In this manner, the movement of the piston 495 to the second position closes off the fluid pathway through the aperture 485.

Thereafter, fluid entering the check valve 460 flows into the inner passageway 560 toward the chamber 625. As fluid collects, a pressure builds within the chamber 625 that creates a force that acts against the chamber shoulder 465. At a predetermined point, the force on the chamber shoulder 465 becomes greater than the biasing force created by the third biasing member 545. At that point, the chamber 625 fills with fluid, thereby urging the piston 450 to start moving axially downward and compressing the third biasing member 545. Furthermore, the piston 450 urges the rods 470 against the blade mechanism 420, thereby opening the blades 480. The piston 450 continues to move axially until the blades 480 are fully opened. At that point, the piston 450 reaches the second position, thereby allowing the apparatus 400 to conduct a under reaming operation or a back reaming operation.

The piston 450 may be shifted from the second position to the first position by reducing the flow of fluid through the mandrel passageway 595. As the fluid flow is reduced, the differential pressure within mandrel passageway 595 is also reduced, thereby allowing the lower piston 495 to move axially upward exposing the aperture 485. Thereafter, fluid from the chamber 625 may flow down the inner passageway through the aperture 485 and into the aperture 505 exiting the apparatus 400. In this manner, the fluid in the chamber 625 is removed allowing the third biasing member 545 to urge the piston 450 from the second position to the first position, thereby releasing the pressure on the rods 470 and allowing the blade mechanism 420 to close the blades 480.

Figure 9:
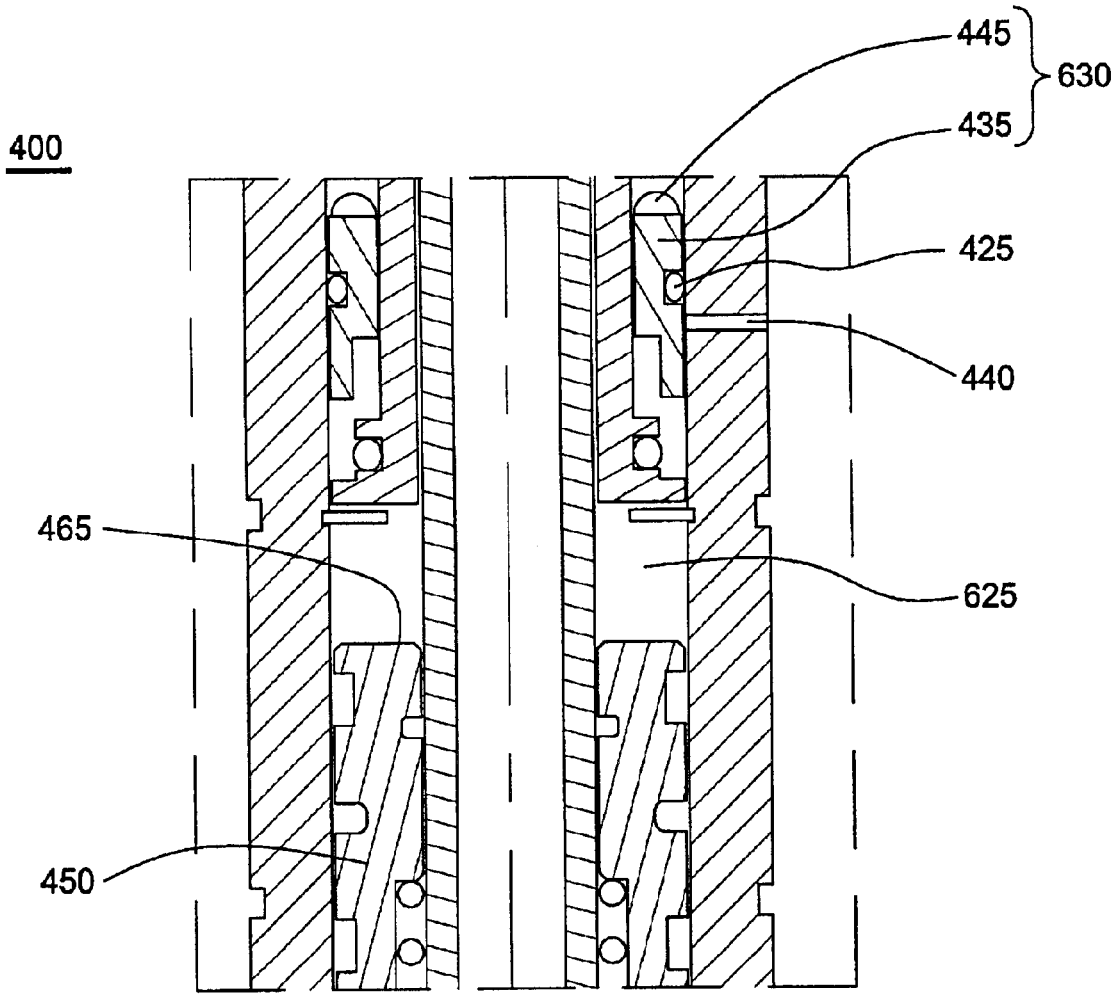
FIG. 9 is an enlarged cross-sectional view of apparatus illustrating the activation of the relief valve.

FIG. 9 is an enlarged cross-sectional view of apparatus 400 illustrating the activation of the relief valve 630. The main function of the relief valve 630 is to provide a means of releasing fluid from chamber 625 when the pressure within the chamber 625 reaches a predetermined amount. After the blades 480 are fully extended as shown in FIG. 8, the apparatus 400 is urged downhole to conduct an under-reaming operation or is urged toward the surface to conduct a back-reaming operation. During the operation, an obstruction may be encountered that may damage the blades 480 if they remain open. Therefore, to prevent damage to blades 480, the relief valve 630 senses the pressure build up in chamber 625 and allows the fluid to exit the chamber 625.

The increased pressure in the chamber 625 creates a force that acts against the upper piston 435. At a predetermined point, the force on the upper piston 435 becomes greater than the biasing force created by the first biasing member 445. At that point, the upper piston 435 moves axially upward, thereby compressing the first biasing member 445. The upward movement of the upper piston 435 causes the seal member 425 to move pass the exit aperture 440, thereby allowing fluid to flow out of the apparatus 400. As the fluid exits out of the chamber 625, the piston 450 moves from the second position to the first position, thereby causing the blade mechanism 420 to close, therefore preventing damage to the blades 480.

The hydraulic components consisting of a check valve, low flow valve, and a relief valve as constructed and arranged in apparatus 100 and apparatus 400 may also be used in the following list of down hole tools: mechanical packers, a valve system for inflatable elements, logging tools/gauging tools, orienting device/kick subs, expandable bits, whipstock setting tools, hammers, inside tubing cutters, accelerators, indexing tools, centralizers, anchors, tool for shifting sleeves, packers, wireline tools, overshots, spears, tractors and others.

While the foregoing is directed to embodiments of the present invention, other and further embodiments of the invention may be devised without departing from the basic scope thereof, and the scope thereof is determined by the claims that follow.

What is claimed is:

1. An apparatus for use in a wellbore tool comprising:

a body having a center bore and at least one side port permitting fluid communication between the bore and an annular area between the tool and the wellbore;

a sliding member movable between a first position and a second position;

a valve assembly for shifting the sliding member to the second position at a predetermined flow rate of fluid through the body;

a collet portion operatively attached to the sliding member, the collet portion movable between a first and a second position; and a pressure relief member for independently allowing the collet portion to move from the second position to the first position at a predetermined pressure.

2. The apparatus of claim 1, wherein at a flow rate below the predetermined flow rate, fluid passing through the at least one side port flows via a fluid path to the wellbore.

3. The apparatus of claim 2, further including a fluid chamber in fluid communication with the bore of the tool, the chamber constructed and arranged to expand in volume at the predetermined flow rate.

4. The apparatus of claim 3, whereby the fluid chamber is biased in a closed position by a spring member, the spring member is overcome when the chamber volume expands.

5. The apparatus of claim 4, whereby as the chamber volume expands there is a corresponding movement of the sliding member towards the second position.

6. A downhole tool for use in a wellbore comprising:

a body having a center bore and a side port, whereby the port permits fluid communication between the bore and an outer portion of the body;

a valve member, wherein the valve member comprises a valve piston and a valve biasing member;

a sliding member, wherein the sliding member moves between a first position and a second position;

a biasing member that biases the sliding member in the first position;

a chamber, wherein the chamber is operately coupled the sliding member;

a relief valve, wherein the relief valve is connected to the chamber;

at least one fluid pathway constructed and arranged to allow fluid to exit the downhole tool;

a check valve for permitting fluid to enter the port and exit out the at least one fluid pathway; and wherein a pressure differential is created within the bore of the body as the fluid flows through the downhole tool.

7. The downhole tool of claim 6, wherein at a high pressure differential fluid enters the port and causes the low flow valve piston to compress the low flow valve biasing member, thereby closing the fluid pathway.

8. The downhole tool of claim 7, wherein closing the fluid pathway allows the fluid to fill the chamber, thereby causing the sliding member to compress the biasing member and move to the second position.

9. An apparatus for a downhole tool comprising:

a mandrel;

a plurality of ramped sections radially disposed around the mandrel;

a plurality of longitudinal grooves radially disposed between the plurality of ramped sections; and a sliding member disposed on the mandrel, the sliding member movable between a first and second position, the sliding member including a plurality of fingers and a plurality of heads, wherein the plurality of fingers are slideably recessed within the plurality of longitudinal grooves.

10. The apparatus of claim 9, whereby the plurality of heads are disposed at the end of each of the plurality of fingers.

11. The apparatus of claim 10, whereby the plurality of ramped sections includes a tapered surface and a flat surface.

12. The apparatus of claim 11, whereby the plurality of heads are disposed at the lower end of the tapered section when the apparatus is in a first position.

13. The apparatus of claim 12, whereby movement of the sliding member moving from the first position to the second position causes the plurality of fingers to slide in the plurality of longitudinal grooves and the plurality of heads to move along the tapered surface toward the flat surface of the plurality of ramped sections, thereby radially extending the plurality of heads.

14. The apparatus of claim 12, whereby the sliding member moving from the second position to the first position causes the plurality of fingers to slide in the plurality of longitudinal grooves and the plurality of heads to slide down the tapered surface of the plurality of ramped sections, thereby radially extending inward the plurality of heads.

15. A collet assembly for use in a wellbore, the collet assembly comprising:

a body;

at least two extendable members movable independent of the body, the members extendable outwards to a rotated position;

at least two sliding members attached to the at least two extendable members, the sliding members remotely movable between a first and second position;

a ramp formed on the body whereby the extendable members are urged along the surface to extend outwards; and whereby, as the extendable members are extended outwards, the extendable members are rotated.

16. The collet assembly of claim 15, wherein the sliding members are recessed into longitudinal grooves formed in the body adjacent the ramp.

17. A method of using a collet assembly in a wellbore, comprising:

running the assembly into the wellbore to a predetermined position, the collet assembly including:

a body having a ramp formed thereupon and at least two radially extendable members movable along the surface of the ramp to a second rotated position wherein the members are extended radially outwards from the body to a rotated position on the body; and remotely causing at least one slidable member to move from a first position to a second position, the slidable member causing the extendable members to move to the second rotated position.

18. The collet assembly of claim 17, wherein the at least one sliding member is recessed into a longitudinal groove formed in the body adjacent the ramp.

19. A method of using a collet assembly in a wellbore, comprising:

running the assembly into the wellbore to a predetermined position, the collet assembly including:

a body having a ramp formed thereupon and at least two radially extendable members movable along the surface of the ramp to a second position wherein the members are extended radially outwards from the body; and remotely causing at least one slidable member to move from a first position to a second position, the slidable member recessed in a longitudinal groove formed in a body adjacent the ramp and causing the members to move to the second position.

20. A method for operating a downhole tool in a wellbore, comprising:

inserting the downhole tool into the wellbore, the downhole tool having:

a body having a center bore and at least one side port permitting fluid communication between the bore and an annular area between the tool and the wellbore;

a sliding member, movable between a first position and a second position;

a valve assembly for shifting the sliding member to the second position at a predetermined flow rate of fluid through the body;

a collet portion operatively attached to the sliding member, the collet portion movable between a first and a second position; and a pressure relief member for independently allowing the collet portion to move from the second position to the first position at a predetermined pressure;

activating the tool by pumping fluid through the body of the downhole tool at a predetermined flow rate, thereby causing the sliding member and the collet portion to move from the first position to the second position.

21. The method of claim 20, whereby the downhole tool further includes a fluid chamber in fluid communication with the bore of the tool, the fluid chamber is constructed and arranged to expand in volume at the predetermined flow rate.

22. The method of claim 21, whereby as the chamber volume expands there is a corresponding movement of the sliding member towards the second position.

23. The method of claim 20, further including deactivating the tool by pumping fluid through the body of the downhole tool below the predetermined flow rate, thereby causing the sliding member and the collet portion to move from the second position to the first position.

24. An apparatus for use in a wellbore tool comprising:

a body having a center bore and at least one side port permitting fluid communication between the bore and an annular area between the tool and the wellbore, wherein at a flow rate below the predetermined flow rate, fluid passing through the at least one side port flows via a fluid path to the wellbore;

a sliding member movable between a first position and a second position;

a valve assembly for shifting the sliding member to the second position at a predetermined flow rate of fluid through the body;

a mechanical portion operatively attached to the sliding member, the mechanical portion operates a radially extendable device at a distal end of the tool, whereby the device is extended when the sliding member is in the second position;

a fluid chamber biased in a close position by a spring member, the fluid chamber in fluid communication with the bore of the tool, whereby at a predetermined flow rate, the spring member is overcome and the chamber expands in volume thereby urging the sliding member towards the second position; and a pressure control member to redirect fluid away from the fluid chamber if the fluid pressure in the chamber reaches a predetermined pressure range.

25. The apparatus of claim 24, further including:

at least one rod;

a blade mechanism; and at least one blade.

26. The apparatus of claim 25, wherein the sliding member comprises a piston member.

27. The apparatus of claim 26, whereby the movement of the sliding member to the second position causes the at least one rod to act against the blade mechanism, thereby expanding the blades radially outward.

28. The apparatus of claim 27, whereby the apparatus is an under-reamer.

29. The apparatus of claim 24, wherein the radially extendable device is a collet.

30. The apparatus of claim 29, wherein the tool is a locator tool.

31. The apparatus of claim 30, wherein the collet includes plurality of collet fingers with a collet head at the end of each finger, wherein the plurality of collet fingers are disposed between a plurality of ramped sections formed in the body.

32. The apparatus of claim 31, whereby the movement of the sliding member to the second position causes the collet heads to ride up the ramped sections, thereby expanding the plurality of collet fingers radially outward.

33. The apparatus of claim 31, whereby the movement of the sliding member to the second position causes the collet head to ride up the ramped sections and rotate outward, thereby expanding the collet head radially outward.

34. The apparatus of claim 33, whereby the apparatus is a locator tool.

35. A collet assembly for use in a wellbore, the collet assembly comprising:

a body;

at least two extendable members movable independent of the body, the members are each semi-circular in profile, and upon movement to the second position, the members extend outward and rotate to a position wherein, a first edge of the semicircular shape extends outwards from a centerline of the body;

a sliding member attached to each member, the sliding member remotely movable between a first and second position, wherein the sliding members are recessed into longitudinal grooves formed in the body; and a ramp formed on the body whereby the members are urged along the surface to extend outwards.

36. A method for operating a downhole tool in a wellbore, comprising:

inserting the downhole tool into the wellbore, the downhole tool having:

a body having a center bore and at least one side port permitting fluid communication between the bore and an annular area between the tool and the wellbore;

a sliding member movable between a first position and a second position;

a valve assembly for shifting the sliding member to the second position at a predetermined flow rate of fluid through the body;

a mechanical portion movable with the sliding member between the first and second positions;

a fluid chamber in fluid communication with the bore of the tool, the fluid chamber constructed and arranged to expand in volume at the predetermined flow rate, thereby urging the sliding member towards the second position; and a pressure control means to redirect fluid away from the fluid chamber if the fluid pressure in the chamber reaches a predetermined pressure range;

activating the tool by pumping fluid through the body of the downhole tool at a predetermined flow rate, thereby causing the sliding member and the mechanical portion to move from the first position to the second position.

* * * * *